US010053314B2

(12) United States Patent
Omori

(10) Patent No.: US 10,053,314 B2
(45) Date of Patent: Aug. 21, 2018

(54) SHEET FEEDING APPARATUS AND IMAGE READING APPARATUS

(71) Applicant: CANON KABUSHIKI KAISHA, Tokyo (JP)

(72) Inventor: Masaki Omori, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/426,326

(22) Filed: Feb. 7, 2017

(65) Prior Publication Data

US 2017/0240364 A1 Aug. 24, 2017

(30) Foreign Application Priority Data

Feb. 18, 2016 (JP) ..... 2016-029282

(51) Int. Cl.
*B65H 3/06* (2006.01)
*B65H 3/04* (2006.01)

(52) U.S. Cl.
CPC ..... *B65H 3/0676* (2013.01); *B65H 3/047* (2013.01); *B65H 3/0669* (2013.01); *B65H 2801/06* (2013.01)

(58) Field of Classification Search
CPC ..... B65H 3/06; B65H 3/0623; B65H 3/0638; B65H 3/0661; B65H 3/0669; B65H 3/0676; B65H 3/32; B65H 3/52; B65H 9/004; B65H 9/006
USPC ..... 271/10.09, 10.11, 122, 242
See application file for complete search history.

(56) References Cited

U.S. PATENT DOCUMENTS 4,606,536 A * 8/1986 Ohara ..... B65H 3/0676 271/118
2008/0136087 A1* 6/2008 Terao ..... B65H 3/0638 271/119
2010/0133738 A1* 6/2010 Kawachi ..... B65H 3/0676 271/10.09
2010/0244363 A1* 9/2010 Sheng ..... B65H 3/063 271/10.09

(Continued)

FOREIGN PATENT DOCUMENTS

JP 10-338391 A 12/1998
JP 2003-201045 A 7/2003

(Continued)

*Primary Examiner* — David H Bollinger
(74) *Attorney, Agent, or Firm* — Fitzpatrick, Cella, Harper & Scinto

(57) ABSTRACT

A sheet feeding apparatus includes a first rotary member to feed a sheet supported on a sheet supporter, a second rotary member to feed the sheet with a feeding force weaker than the first rotary member, and a third rotary member in contact with a separation member to separate the sheets fed by the first rotary member one by one. A drive transmission switches between a first drive transmission state in which a driving force from a motor to the first rotary member and the third rotary member is transmitted while the driving force from the motor to a second rotary member is cut off, and a second drive transmission state in which the driving force from the motor to the second rotary member is transmitted while the driving force from the motor to the first rotary member and the third rotary member is cut off.

14 Claims, 6 Drawing Sheets

(56) References Cited

U.S. PATENT DOCUMENTS

| | | | | |
|---|---|---|---|---|
| 2012/0061905 | A1* | 3/2012 | Wu | B65H 3/063<br>271/34 |
| 2013/0241139 | A1* | 9/2013 | Hayakawa | B65H 3/0684<br>271/117 |
| 2013/0285308 | A1* | 10/2013 | Tajima | B65H 3/0684<br>271/117 |

FOREIGN PATENT DOCUMENTS

| | | | |
|---|---|---|---|
| JP | 2007-302356 | A | 11/2007 |
| JP | 2009-126617 | A | 6/2009 |

* cited by examiner

SHEET FEEDING APPARATUS AND IMAGE READING APPARATUS

BACKGROUND OF THE INVENTION

Field of the Invention

The present invention relates to a sheet feeding apparatus configured to feed sheets, and an image reading apparatus equipped with the same.

Description of the Related Art

Hitherto, as disclosed in Japanese Unexamined Patent Application Publication No. 10-338391, an automatic document feeding device is proposed in which a document supported on a document supporting plate is fed by a pickup roller, and the document fed by the pickup roller is separated one by one using a feed roller and a reverse roller. The separated document is subjected to skew feed correction by a registration roller, and then conveyed to an image reading unit.

According to the automatic document feeding device, the pickup roller, the feed roller, the reverse roller and the registration roller are driven by a single paper feeding motor. In a state where the paper feeding motor is rotated in a normal direction, the pickup roller, the feed roller and the reverse roller are rotated, and the registration roller is stopped. In a state where the paper feeding motor is rotated in a reverse direction, the pickup roller, the feed roller and the reverse roller are stopped, and the registration roller is rotated.

As described, the automatic document feeding device taught in Japanese Unexamined Patent Application Publication No. 10-338391 switches the driving states of the respective rollers by rotating the paper feeding motor in normal and reverse directions. In a state where the paper feeding motor is rotated in the reverse direction, the pickup roller will not rotate. That is to say, in a state where a preceding document is conveyed by the registration roller, a succeeding document will not be fed, and only after the conveyance of the preceding document by the registration roller is completed, the paper feeding motor is rotated in the normal direction, and the pickup roller starts conveying the succeeding document.

Therefore, the distance between the preceding document and the succeeding document is increased, and a long processing time is required to complete conveying all the documents supported on the document supporting plate, so that productivity is deteriorated.

SUMMARY OF THE INVENTION

The present invention provides a sheet feeding apparatus including a sheet supporting unit configured to support a sheet, a first rotary member configured to feed the sheet supported on the sheet supporting unit, a separation unit configured to separate the sheet fed by the first rotary member one by one, a second rotary member configured to feed the sheet supported on the sheet supporting unit, a driving source capable of driving the first rotary member, the separation unit and the second rotary member, and a drive transmission mechanism capable of switching between a first drive transmission state in which a driving force from the driving source to the first rotary member and the separation unit is transmitted while the driving force from the driving source to the second rotary member is cut off, and a second drive transmission state in which the driving force from the driving source to the second rotary member is transmitted while the driving force from the driving source to the first rotary member and the separation unit is cut off, wherein the second rotary member is configured to feed the sheet supported on the sheet supporting portion by applying a feeding force weaker than the first rotary member.

Further features of the present invention will become apparent from the following description of exemplary embodiments with reference to the attached drawings.

DESCRIPTION OF THE EMBODIMENTS

First Embodiment

Overall Configuration

At first, a first embodiment of the present invention will be described. An image reading apparatus 1 according to the first embodiment is provided, for example, on an upper portion of a laser beam printer adopting an electro-photographic system, and a document image read by the image reading apparatus 1 is printed onto a sheet in an image forming unit of a printer body not shown.

Figure 1:
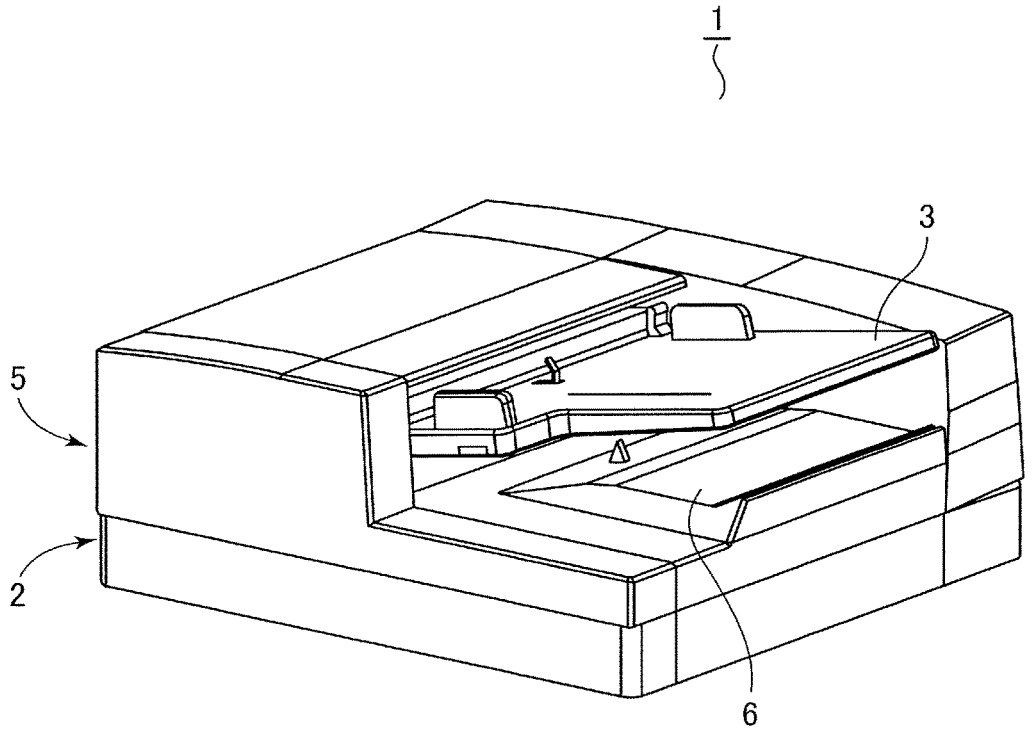
FIG. 1 is a perspective view illustrating an image reading apparatus according to a first embodiment.
Figure 2:
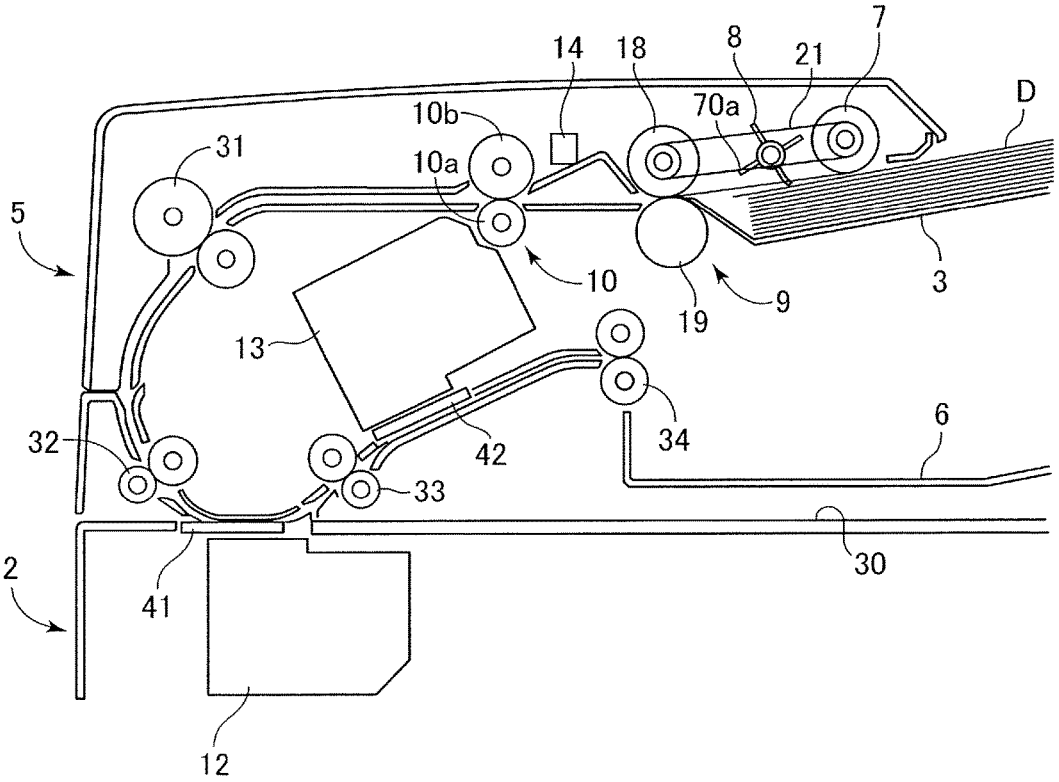
FIG. 2 is a sectional side view illustrating the image reading apparatus.

The image reading apparatus 1 includes, as illustrated in FIGS. 1 and 2, an automatic document feeder, hereinafter abbreviated as ADF 5, feeding a document supported on a document tray 3, serving as a sheet supporting portion, and discharging the document onto a sheet discharge tray 6, and a reading unit 2 reading the document conveyed by the ADF 5. The ADF 5 is supported pivotably on the reading unit 2 via a hinge, such that a platen glass 30 can be exposed. The document D, i.e., sheet, can be a blank sheet, or it can have an image formed on one side or on both sides thereof.

As illustrated in FIG. 2, the ADF 5 includes a pickup roller 7, serving as a first rotary member, a separation roller pair 9, serving as a separation portion, a registration roller pair 10, serving as a skew feed correction rotary member, a plurality of conveyance roller pairs 31, 32 and 33, and a sheet discharge roller pair 34. Further, the ADF 5, serving as a sheet feeding apparatus, includes a paddle 8 described later, serving as a second rotary member, a drive transmission mechanism 51 (refer to FIG. 4), motors M1 and M2 (refer to FIG. 4), a second platen glass 42, a second reading unit 13, and a passage sensor 14.

The pickup roller 7 and the paddle 8 are supported rotatably above the document tray 3. The separation roller pair 9 is composed of a feed roller 18 and a separation roller 19, and separates the documents one by one. A torque limiter is disposed between the separation roller 19 and a drive shaft thereof. A load of the torque limiter is set as follows. In a case where only one sheet of document enters a nip portion of the separation roller pair 9, the separation roller 19 receives force by the rotation of the feed roller 18, and the roller is driven to rotate by the feed roller 18. On the other hand, in a case where a plurality of sheets of documents enter the nip portion of the separation roller pair 9, the separation roller 19 is not driven to rotate by the feed roller 18. The separation roller pair 9 separates the documents one by one by setting the load of the torque limiter as described. A drive in an opposite direction as the document feeding direction, i.e., sheet feeding direction, of the pickup roller 7 can be entered to the separation roller 19, or alternately, a separating pad and the like can be used instead of the separation roller 19. The registration roller pair 10 is arranged downstream of the separation roller pair 9 in the feeding direction, and the registration roller pair 10 is composed of a driving roller 10*a* to which driving force is entered, and a driven roller 10*b* driven to rotate by the driving roller 10*a*.

The reading unit 2 includes a first platen glass 41, a platen glass 30 on which the document is placed, and a first reading unit 12, serving as an image reading unit, wherein the first reading unit 12 is configured to be able to move in a sub-scanning direction, that is, in a crosswise direction of the FIG. 2. The first reading unit 12 and the second reading unit 13, serving as image reading units, respectively have a light source, a photoelectric conversion element, a mirror and a lens disposed therein. The light emitted from the light source is reflected by the document, and the reflected light from the document is incident on the photoelectric conversion element through the mirror and lens. The photoelectric conversion element obtains the image of the document as image information by performing photoelectric conversion of reflected light from the document.

The first platen glass 41 and the second platen glass 42 are both formed of a transparent member, such as glass, that transmits light. A mode of reading a document while it is conveyed by the ADF 5 is referred to as a document feeding-reading mode, and a mode of fixing a document on the platen glass 30 and reading the document by moving the first reading unit 12 in a sub-scanning direction is referred to as a document fixed reading mode.

In the case of the document fixed reading mode, the user opens the ADF 5 and places the document on the platen glass 30. Then, the user operates an operation panel not shown to start the document fixed reading by the image reading apparatus 1, and the first reading unit 12 moves in the sub-scanning direction to read the image of the document placed on the platen glass 30.

In the case of the document feeding-reading mode, the user places the document on the document tray 3, and operates the operation panel to start the document feeding-reading by the image reading apparatus 1. At this time, the first reading unit 12 reads the image in a state being stopped below the first platen glass 41, as illustrated in FIG. 2. The document D supported on the document tray 3 is fed by the pickup roller 7, and the document is separated one sheet at a time by the separation roller pair 9. Then, the document D is abutted against the stopped registration roller pair 10, by which a loop is formed, and skew feed of the document is corrected. The document D whose skew feed has been corrected is conveyed by driving the registration roller pair 10, and is further conveyed by conveyance roller pairs 31 and 32 to the first platen glass 41.

The image on a first surface, i.e., front surface, of the document D is read via the first platen glass 41 by the first reading unit 12. The document D whose image has been read by the first reading unit 12 is conveyed by a conveyance roller pair 33 to the sheet discharge roller pair 34, and discharged by the sheet discharge roller pair 34 onto the discharge tray 6. In a case where the image on a second surface, i.e., rear surface, of the document D is to be read, the document whose image on the first surface has been read by the first reading unit 12 has been the image on the second surface read via the second platen glass 42 by the second reading unit 13.

Control Unit

Figure 3:
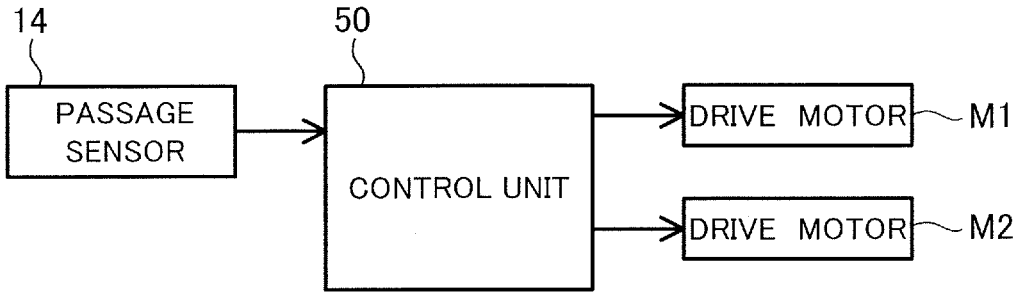
FIG. 3 is a control block diagram of a control unit.

FIG. 3 is a control block diagram of the image reading apparatus 1. A control unit 50 includes a CPU, a ROM, a RAM and so on built therein, and can be disposed on the image reading apparatus 1 or on a printer body not shown. The passage sensor 14 arranged upstream of the registration roller pair 10 in the feeding direction is connected to an input side of the control unit 50, and the passage sensor 14 detects the leading end of the document conveyed by the separation roller pair 9.

Drive motors M1 and M2 are connected to an output side of the control unit 50, and the drive motor M1, serving as a driving source, drives the pickup roller 7, the feed roller 18, the driving roller 10*a* of the registration roller pair 10 and the paddle 8 via the drive transmission mechanism 51. The drive motor M2 can drive the conveyance roller pairs 31, 32 and 33 and the sheet discharge roller pair 34. Since the drive system and the like are divided into two parts according to the present embodiment, even in a case where drastic load is applied on the drive motor M1 by driving and stopping the drive motor M1 repeatedly, the drive motor M2 is not affected. Therefore, the stability of conveyance speed of the document by the conveyance roller pairs 31, 32 and 33 and the sheet discharge roller pair 34 can be ensured.

Drive Transmission Mechanism

Figure 4:
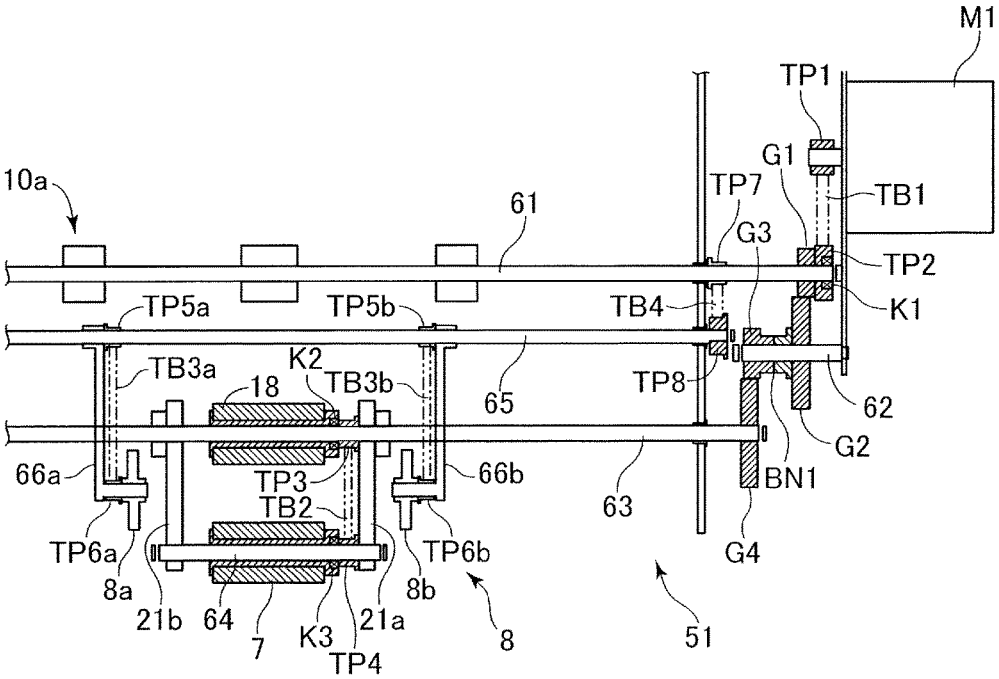
FIG. 4 is a cross-sectional view illustrating a drive transmission mechanism.

Next, the drive transmission mechanism 51 transmitting the driving force of the drive motor M1 to the pickup roller 7, the feed roller 18, the driving roller 10*a* of the registration roller pair 10 and the paddle 8 will be described in detail. As illustrated in FIG. 4, the drive transmission mechanism 51 is interposed between the drive motor M1 and the pickup roller 7, the feed roller 18, the driving roller 10*a* of the registration roller pair 10 and the paddle 8, and transmits the driving force of the drive motor M1 to the respective members. Hereafter, respective members composing the drive transmission mechanism 51 will be described.

A timing pulley TP1 is fixed to the drive shaft of the drive motor M1, and a timing belt TB1 is wound around the timing pulley TP1 and a timing pulley TP2. The timing pulley TP2 is fixed to a drive shaft 61 of the driving roller 10*a* of the registration roller pair 10 via a one-way clutch K1. In a state where the drive motor M1 is rotated in a normal direction, the one-way clutch K1 does not transmit the driving force of the drive motor M1 to the drive shaft 61, and in a state where the drive motor M1 is rotated in a reverse direction, the clutch K1 transmits the driving force of the drive motor M1 to the drive shaft. In a state where a direction of rotation of the drive motor M1 rotating in the normal direction is referred to as a first direction, a direction of rotation of the drive motor M1 rotating in the reverse direction is referred to as a second direction opposite to the first direction.

The timing pulley TP2 is formed integrally with a gear G1, and the gear G1 is meshed with a gear G2 fixed to a counter shaft 62. The gear G2 is connected via a spring clutch BN1 with a gear G3 disposed on the counter shaft 62. In a state where the drive motor M1 is rotated in the normal direction, the spring clutch BN1 fastens the gears G2 and G3 to thereby transmit the driving force of the gear G2 to the gear G3. Further, the spring clutch BN1 is released in a radial direction in a state where the drive motor M1 is rotated in the reverse direction, so that a driving force exceeding a fixed amount will not be transmitted from the gear G2 to the gear G3.

The gear G3 is meshed with a gear G4, and the gear G4 is fixed to a drive shaft 63 of the feed roller 18. Retaining members 21*a* and 21*b* are supported pivotably on the drive shaft 63, and a drive shaft 64 of the pickup roller 7 is supported rotatably on a leading end of the retaining members 21*a* and 21*b*. The driving force of the drive shaft 63 of the feed roller 18 is transmitted via the timing pulleys TP3 and TP4 and the timing belt TB2 to the drive shaft 64 of the pickup roller 7. In the present embodiment, the timing belt TB2 is disposed only on the side of the one retaining member 21*a*, but it can also be disposed on the side of the other retaining member 21*b*.

The feed roller 18 and the pickup roller 7 are respectively fixed via one-way clutches K2 and K3 to the drive shaft 63 and 64. In a state where the drive motor M1 is rotated in the normal direction, the one-way clutch K2 transmits the driving force of the drive motor M1 to the feed roller 18, and in a state where the drive motor M1 is rotated in the reverse direction, the clutch K2 does not transmit the driving force of the drive motor M1 to the feed roller 18. Similarly, in a state where the drive motor M1 is rotated in the normal direction, the one-way clutch K3 transmits the driving force of the drive motor M1 to the pickup roller 7, and in a state where the drive motor M1 is rotated in the reverse direction, the clutch K3 does not transmit the driving force of the drive motor M1 to the pickup roller 7.

Further, a timing pulley TP7 is fixed to the drive shaft 61 of the driving roller 10*a* of the registration roller pair 10, and a timing belt TB4 is wound around the timing pulley TP7 and a timing pulley TP8 fixed to a support shaft 65. A pair of arms 66*a* and 66*b* is supported on the support shaft 65, and left and right paddle portions 8*a* and 8*b* constituting the paddle 8 are respectively rotatably supported on leading ends of the pair of arms 66*a* and 66*b*.

Timing pulleys TP5*a* and TP5*b* are fixed to the support shaft 65, and a driving force of the timing pulley TP5*a* is transmitted via a timing belt TB3*a* and a timing pulley TP6*a* to the left paddle portion 8*a*. Similarly, the driving force of the timing pulley TP5*b* is transmitted via a timing belt TB3*b* and a timing pulley TP6*b* to the right paddle portion 8*b*.

The left and right paddle portions 8*a* and 8*b* have a plurality of elastic strips 70*a* (refer to FIG. 2) formed of an elastic body and projected radially from a rotation center portion. The plurality of elastic strips 70*a* are formed relatively thin, and are flexible. In the present embodiment, the left and right paddle portions 8*a* and 8*b* respectively have four elastic strips, but the number of elastic strips can be any number greater than one.

Document Feeding Operation

Next, a feeding operation of the document D supported on the document tray 3 will be described in detail. In a case where the user enters a feed job from an operation panel or an outside computer not shown, the control unit 50 rotates the drive motor M1 in the normal direction. While the drive motor M1 is rotated in the normal direction, the one-way clutch K1 rotates idly, so that the driving roller 10*a* of the registration roller pair 10 and the paddle 8 are not driven. Further, the one-way clutches K2 and K3 and the spring clutch BN1 are in a transmission state transmitting the driving force, so that the driving force of the drive motor M1 is transmitted to the pickup roller 7 and the feed roller 18.

As described, a state where the driving force from the drive motor M1 to the pickup roller 7 and the feed roller 18 is transmitted and the driving force from the drive motor M1 to the driving roller 10*a* of the registration roller pair 10 and the paddle 8 is cut off is referred to as a first drive transmission state.

The document D supported on the document tray 3 is fed by the pickup roller 7, and separated one by one by the feed roller 18 and the separation roller 19. The leading end of the document D having passed the feed roller 18 and the separation roller 19 is detected by the passage sensor 14, and abuts against the registration roller pair 10 in the stopped state, such that skew feed is corrected.

The control unit 50 counts a time sufficient to correct skew feed of the document D based on a detection timing by the passage sensor 14, and rotates the drive motor M1 in the reverse direction. In a state where the drive motor M1 is rotated in the reverse direction, the one-way clutches K2 and K3 and the spring clutch BN1 are in a non-transmission state where the driving force is not transmitted, and the one-way clutch K1 is in a transmission state where the driving force is transmitted. Therefore, the driving roller 10*a* of the registration roller pair 10 and the paddle 8 are driven, and the pickup roller 7 and the feed roller 18 are not driven.

As described, the state in which the driving force from the drive motor M1 to the driving roller 10*a* of the registration roller pair 10 and the paddle 8 is transmitted and the driving force from the drive motor M1 to the pickup roller 7 and the feed roller 18 is cut off is referred to as a second drive transmission state. That is, the drive transmission mechanism 51 switches between the first drive transmission state and the second drive transmission state by driving the drive motor M1 to be rotated in the normal direction or in the reverse direction, according to which the pickup roller 7 and the feed roller 18, or the driving roller 10*a* and the paddle 8, are driven alternatively.

When the drive motor M1 is rotated in the reverse direction, the document D whose skew feed has been corrected by the registration roller pair 10 is conveyed to the conveyance roller pair 31. Then, after a trailing edge of the document D passes the passage sensor 14 and the document D is no longer detected by the passage sensor 14, the control unit 50 rotates the drive motor M1 in the normal direction again. It becomes possible to feed the document using a single motor by driving the drive motor M1 to rotate in the normal and reverse directions, as described above. Further, it is also possible to configure the drive shaft 63 and the retaining members 21*a* and 21*b* to be able to transmit the drive using an electromagnetic clutch and the like, and to pivot the retaining members 21*a* and 21*b* to an upper direction after the feed job is completed. Thereby, the pickup roller 7 is elevated, and documents can be supplied to the document tray 3.

The paddle 8 is arranged between the pickup roller 7 and the feed roller 18 in the sheet feeding direction, and the paddle rotates while a preceding document is conveyed by the registration roller pair 10, feeding a succeeding document to the stopped separation roller pair 9. The material and shape of the paddle 8 and contact pressure thereof to the document D are determined so that the paddle 8 has a weaker feeding force than the pickup roller 7. Therefore, in a state where the drive motor M1 is rotated in the reverse direction, and where the drive transmission mechanism 51 is in the second drive transmission state, after the leading end of the succeeding document reaches the separation roller pair 9, the paddle 8 slides on the surface of the document without moving the document further. In other words, since the paddle 8 has a weak feeding force, the document will not move further due to a resistance of the separation roller pair 9.

Since the paddle 8 feeds the document to the separation roller pair 9 while the pickup roller 7 is stopped, the distance between the preceding document and the succeeding document is reduced. The time required to complete feeding of all sheets is shortened, so that the productivity of the apparatus is improved. The paddle 8 will not apply a feeding force as strong as the force applied by the pickup roller 7 on the document having its leading end reach the separation roller pair 9, so that the document is prevented from being buckled, and the occurrence of damage on the document can be reduced. Further, in comparison to a configuration in which the conveyance speed of the pickup roller is increased to reduce the distance between documents, the present configuration can reduce noise.

The feeding force of the paddle 8 described above refers to a force that the paddle 8 applies on the document to move the document, and the force is increased or decreased in proportion to a contact pressure of the paddle 8 to the document and a coefficient of friction between the paddle 8 and the document. One specific method of measuring the feeding force is a method of measuring the force of movement of the document being fed using a force measuring unit such as a spring balance.

In order to weaken the feeding force applied by the paddle 8 compared to the feeding force of the pickup roller 7, the contact pressure applied by the paddle 8 on the document during feeding should be set smaller than the contact pressure applied by the pickup roller 7 on the document during feeding. Alternatively, the coefficient of friction between the paddle 8 and the document is set smaller than the coefficient of friction between the pickup roller 7 and the document. Of course, both the contact pressure and the coefficient of friction of the paddle 8 can be reduced.

The present embodiment uses the paddle 8 having flexibility, so that the contact pressure that the paddle 8 applies on the document can be made small easily compared to that of the pickup roller 7 in the shape of a roller, and the feeding force of the paddle 8 can be set to a small value.

The present embodiment adopts a configuration in which the drive motor M1 is rotated in normal and reverse directions to thereby transmit or cut off the driving force to the pickup roller 7, the feed roller 18, the driving roller 10*a* and the paddle 8, but the configuration is not restricted to this example. For example, it is possible to adopt a configuration in which the drive motor is rotated in one direction, and the transmitting and cutting off of the driving force to the pickup roller 7, the feed roller 18, the driving roller 10*a* and the paddle 8 is switched by attracting or separating electromagnetic clutches.

It is also possible to drive the pickup roller 7, the feed roller 18 and the paddle 8 by one motor, and drive the driving roller 10*a* of the registration roller pair 10 by another motor.

According to the present embodiment, productivity can be improved by the paddle, serving as the second rotary member, conveying the succeeding sheet to the separation portion, and reducing the distance with the preceding sheet.

Second Embodiment

Next, a second embodiment of the present invention will be described. The second embodiment adopts a configuration in which the paddle 8 of the first embodiment is replaced with a different configuration. The same configurations as the first embodiment are either not shown or denoted with the same reference numbers in the description.

Figure 5:
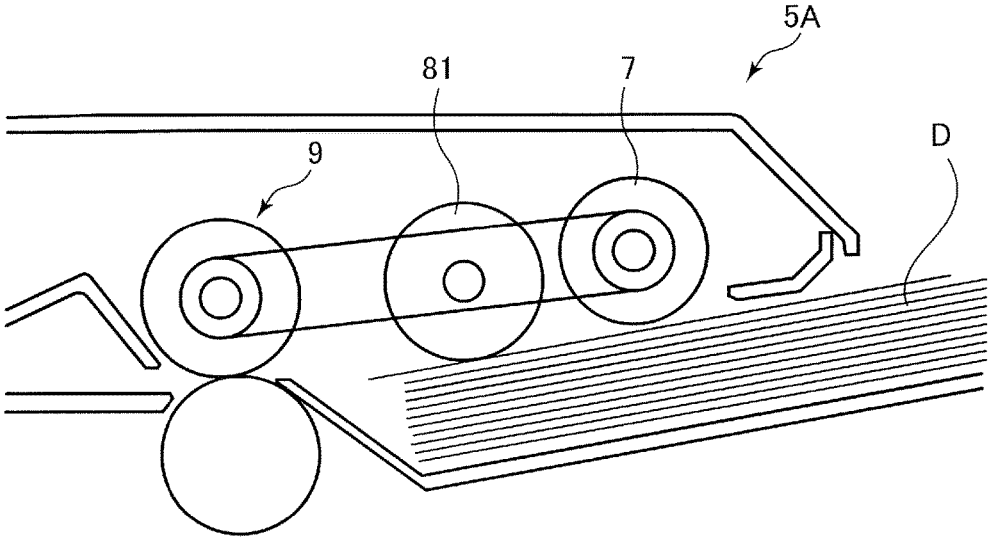
FIG. 5 is a sectional side view illustrating an elastic roller according to a second embodiment.

As illustrated in FIG. 5, an ADF 5A includes an elastic roller 81, serving as a second rotary member, disposed between the pickup roller 7 and the separation roller pair 9. The pickup roller 7 and the elastic roller 81 are both formed of cylindrical elastic bodies, and the elastic roller 81 is a roller, such as a roller formed of a foamed material, having a lower hardness than the pickup roller 7. A synthetic sponge formed by foaming synthetic resin such as polyurethane, for example, can be used as an easily deformable material with a low hardness. The pickup roller 7 is a solid rubber roller formed of rubber.

In order to weaken the feeding force applied by the elastic roller 81 compared to the feeding force applied by the pickup roller 7, the contact pressure applied by the elastic roller 81 on the document during feeding should be set smaller than the contact pressure applied by the pickup roller 7 on the document during feeding. Alternatively, the coefficient of friction between the elastic roller 81 and the document is set smaller than the coefficient of friction between the pickup roller 7 and the document. Of course, both the contact pressure and the coefficient of friction of the elastic roller 81 can be reduced.

According to one embodiment, the contact pressure of the elastic roller 81 on the document D is set smaller than the contact pressure of the pickup roller 7 on the document D. Thereby, the contact pressure of the elastic roller 81 on the document D is set low, and the feeding force can be suppressed.

In a state where the drive motor M1 is rotated in the reverse direction, and where the drive transmission mechanism 51 is in the second drive transmission state, after the leading end of the succeeding document reaches the separation roller pair 9, the elastic roller 81 slides on the surface of the document without moving the document further. In other words, since the elastic roller 81 has a weak feeding force, the document will not move any further due to a resistance of the separation roller pair 9, and the occurrence of damage on the document, for example by buckling, can be reduced by the rotation of the elastic roller 81.

According to the present embodiment, since the roller formed of the foamed material and serving as the second rotary member conveys the succeeding sheet to the separation portion, the distance between the succeeding and preceding sheets is reduced, and the productivity is improved.

Third Embodiment

Next, a third embodiment of the present invention will be described. The third embodiment adopts a configuration in which the paddle 8 of the first embodiment is replaced with a different configuration. The same configurations as the first embodiment are either not shown or denoted with the same reference numbers in the description.

Figure 6:
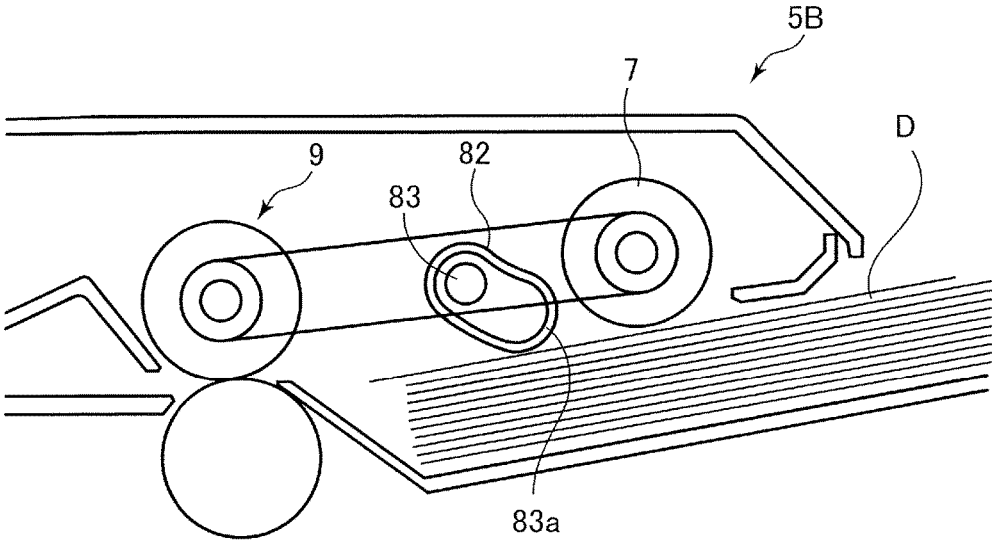
FIG. 6 is a sectional side view illustrating an endless belt according to a third embodiment.

As illustrated in FIG. 6, an ADF 5B includes an endless belt 82, serving as a second rotary member, and a retaining portion 83 retaining a portion of an inner circumference of a belt 82, which are disposed between the pickup roller 7 and the separation roller pair 9. The belt 82 has a side opposite from the retaining portion 83 serve as a free end 83*a*, and the document is fed by the free end 83*a* in rotation contact the document.

In order to weaken the feeding force applied by the belt 82 compared to the feeding force of the pickup roller 7, the contact pressure applied by the belt 82 on the document during feeding should be set smaller than the contact pressure applied by the pickup roller 7 on the document during feeding. Alternatively, the coefficient of friction between the belt 82 and the document is set smaller than the coefficient of friction between the pickup roller 7 and the document. Of course, both the contact pressure and the coefficient of friction of the belt 82 can be reduced.

According to the present embodiment, the free end 83*a* is configured to have a low contact pressure on the document D, so that the feeding force can be suppressed.

In a state where the drive motor M1 is rotated in the reverse direction, and where the drive transmission mechanism 51 is in the second drive transmission state, after the leading end of the succeeding document reaches the separation roller pair 9, the belt 82 slides on the surface of the document without moving the document further. In other words, since the belt 82 has a weak feeding force, the document will not move any further due to the resistance of the separation roller pair 9, and the occurrence of damage of the document, for example by buckling, can be reduced by the rotation of the belt 82.

According to the present embodiment, since the endless belt serving as the second rotary member conveys the succeeding sheet to the separation portion, the distance between the succeeding and preceding sheets can be reduced, and the productivity can be improved.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-029282, filed Feb. 18, 2016, which is hereby incorporated by reference herein in its entirety.

What is claimed is:

1. A sheet feeding apparatus comprising:

a sheet supporter configured to support a sheet;

a first rotary member configured to feed the sheet supported on the sheet supporter;

a second rotary member configured to feed the sheet supported on the sheet supporter with a feeding force weaker than the first rotary member;

a third rotary member in contact with a separation member and configured to separate sheets fed by the first rotary member one by one;

a motor driving the first rotary member, the third rotary member and the second rotary member; and a drive transmission switching between a first drive transmission state in which a driving force from the motor to the first rotary member and the third rotary member is transmitted while the driving force from the motor to the second rotary member is cut off, and a second drive transmission state in which the driving force from the motor to the second rotary member is transmitted while the driving force from the motor to the first rotary member and the third rotary member is cut off, wherein the drive transmission switches driving states such that the first drive transmission state is selected in a state where the motor is driven in a first direction, and the second drive transmission state is selected in a state where the motor is driven in a second direction opposite to the first direction.

2. The sheet feeding apparatus according to claim 1, further comprising:

supporting arms for rotatably supporting the first rotary member and the second rotary member above the sheet supporter.

3. The sheet feeding apparatus according to claim 1, wherein the second rotary member comprises an elastic strip formed of an elastic body and projected radially from a rotation center.

4. The sheet feeding apparatus according to claim 1, wherein the first rotary member is a rubber roller formed of rubber, and the second rotary member is a roller formed of foamed material.

5. The sheet feeding apparatus according to claim 1, further comprising a holder configured to rotatably hold a portion of an inner circumference of an endless belt, and wherein the second rotary member is the endless belt, wherein the endless belt rotates in a state where an opposite side from the holder is a free end.

6. The sheet feeding apparatus according to claim 1, further comprising a skew feed correction rotary member arranged downstream of the third rotary member in a sheet feeding direction in which the sheet is fed, configured to correct skew feed of the sheet and to convey the sheet conveyed by the third rotary member, and wherein the drive transmission is configured to transmit the driving force from the motor to the skew feed correction rotary member during the second drive transmission state, and cut off the driving force from the motor to the skew feed correction rotary member during the first drive transmission state.

7. The sheet feeding apparatus according to claim 1, wherein the second rotary member is flexible and configured to contact the sheet supported by the sheet supporter with a smaller contact pressure than the first rotary member.

8. The sheet feeding apparatus according to claim 1, wherein the second rotary member has a smaller coefficient of friction with the sheet supported on the sheet supporter than the first rotary member.

9. The sheet feeding apparatus according to claim 1, wherein the second rotary member is configured to feed the sheet so that a leading end of the sheet reaches the third rotary member, and after the sheet reaches the third rotary member, the second rotary member has a coefficient of friction allowing it to slide on the sheet without moving the sheet.

10. The sheet feeding apparatus according to claim 1, wherein the second rotary member is arranged between the first rotary member and the third rotary member in a feeding direction of the sheet.

11. A sheet feeding apparatus comprising:

a sheet supporter configured to support a sheet;

a roller configured to feed the sheet supported on the sheet supporter;

a rotary member in contact with a separation member and configured to separate sheets fed by the roller one by one;

a paddle comprising a plurality of elastic strips formed by an elastic body and projecting radially from a rotation center and arranged between the roller and the rotary member in a feeding direction of the sheet, and configured to feed the sheet supported on the sheet supporter;

a motor driving the roller, the rotary member, and the paddle; and a drive transmission having a first drive transmission state in which a driving force from the motor to the roller and the rotary member is transmitted while the driving force from the motor to the paddle is cut off, and a second drive transmission state in which the driving force from the motor to the paddle is transmitted while the driving force from the motor to the roller and the rotary member is cut off.

12. A sheet feeding apparatus comprising:

a sheet supporter configured to support a sheet;

a rubber roller formed of rubber and configured to feed the sheet supported on the sheet supporter;

a rotary member in contact with a separation member and configured to separate sheets fed by the rubber roller one by one;

a foamed roller formed of foamed material arranged between the rubber roller and the rotary member in a feeding direction of the sheet, and configured to feed the sheet supported on the sheet supporter;

a motor driving the rubber roller, the rotary member, and the foamed roller; and a drive transmission having a first drive transmission state in which a driving force from the motor to the rubber roller and the rotary member is transmitted while the driving force from the motor to the foamed roller is cut off, and a second drive transmission state in which the driving force from the motor to the foamed roller is transmitted while the driving force from the motor to the rubber roller and the rotary member is cut off.

13. A sheet feeding apparatus comprising:

a sheet supporter configured to support a sheet;

a roller configured to feed the sheet supported on the sheet supporter;

a rotary member in contact with a separation member and configured to separate sheets fed by the roller one by one;

a rotating endless belt having a portion of an inner circumference of the endless belt held rotatably and an opposite side from the portion set as a free end, the endless belt arranged between the roller and the rotary member in a feeding direction of the sheet and configured to feed the sheet supported on the sheet supporter;

a motor driving the roller, the rotary member, and the endless belt; and a drive transmission having a first drive transmission state in which a driving force from the motor to the roller and the rotary member is transmitted while the driving force from the motor to the endless belt is cut off, and a second drive transmission state in which the driving force from the motor to the endless belt is transmitted while the driving force from the motor to the roller and the rotary member is cut off.

14. An image reading apparatus comprising:

the sheet feeding apparatus according to claim 1; and an image reader configured to read an image on a sheet fed by the sheet feeding apparatus.

* * * * *